US008903115B2

(12) United States Patent
Li et al.

(10) Patent No.: US 8,903,115 B2
(45) Date of Patent: Dec. 2, 2014

(54) ENCLOSURE AND ACOUSTIC DEVICE USING THE SAME

(75) Inventors: Wen-Zhen Li, Beijing (CN); Hwang-Miaw Chen, Taipei Hsien (TW)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 1011 days.

(21) Appl. No.: 12/978,614

(22) Filed: Dec. 26, 2010

(65) Prior Publication Data

US 2011/0305361 A1 Dec. 15, 2011

(30) Foreign Application Priority Data

Jun. 14, 2010 (CN) ..... 2010 1 0201342

(51) Int. Cl.

| | |
|---|---|
| ***H04R 1/02*** | (2006.01) |
| ***C22C 1/00*** | (2006.01) |
| ***C22C 1/10*** | (2006.01) |
| ***C22C 23/00*** | (2006.01) |
| ***C22C 23/02*** | (2006.01) |
| ***C22C 47/08*** | (2006.01) |
| ***C22C 49/04*** | (2006.01) |
| ***C22C 49/14*** | (2006.01) |
| *A47B 81/06* | (2006.01) |

(52) U.S. Cl.

CPC ..... *C22C 1/005* (2013.01); *C22C 1/1036* (2013.01); *C22C 23/00* (2013.01); *C22C 23/02* (2013.01); *C22C 47/08* (2013.01); *C22C 49/04* (2013.01); *C22C 49/14* (2013.01); *B22F 2998/00* (2013.01)

USPC ..... 381/345; 181/198

(58) Field of Classification Search

USPC ..... 381/370, 380, 386; 148/557, 538; 29/594

See application file for complete search history.

(56) References Cited

U.S. PATENT DOCUMENTS

| | | | |
|---|---|---|---|
| 7,983,438 | B2 | 7/2011 | Tsunoda |
| 2001/0055539 | A1 | 12/2001 | Nakamura et al. |
| 2005/0000319 | A1 | 1/2005 | Huang et al. |
| 2008/0159906 | A1 | 7/2008 | Suganuma et al. |
| 2009/0061211 | A1 | 3/2009 | Chan et al. |
| 2009/0127743 | A1 | 5/2009 | Chan et al. |
| 2009/0288911 | A1 | 11/2009 | Chen et al. |
| 2009/0317622 | A1 | 12/2009 | Huang et al. |
| 2010/0075064 | A1 | 3/2010 | Chan et al. |

FOREIGN PATENT DOCUMENTS

| | | |
|---|---|---|
| CN | 101376276 | 3/2009 |
| CN | 101527873 A | 9/2009 |
| CN | 101588521 | 11/2009 |

(Continued)

OTHER PUBLICATIONS

Liao Lin, Yuan qiuhong, "Microstructure and Mechanical Properties of AZ91 Alloy composites Reinforced with Ni-Coated Carbon Nanotubes", Materials for Mechanical Engineering, China, vol. 34, No. 1, pp. 92-95, Jan. 2010.

(Continued)

*Primary Examiner* — Curtis Kuntz
*Assistant Examiner* — Sunita Joshi
(74) *Attorney, Agent, or Firm* — Novak Druce Connolly Bove + Quigg LLP

(57) ABSTRACT

The present disclosure relates to an acoustic device. The acoustic device includes an enclosure and a speaker enclosed by the enclosure. The enclosure includes a magnesium based composite material. The magnesium based composite material includes a magnesium based metal matrix and nanoparticles dispersed therein. The present disclosure also relates to an earphone.

15 Claims, 12 Drawing Sheets

(56) References Cited

FOREIGN PATENT DOCUMENTS

| | | |
|---|---|---|
| JP | 4-28835 | 1/1992 |
| JP | 6-73469 | 3/1994 |
| JP | 6-238422 | 8/1994 |
| JP | 2004-136363 | 5/2004 |
| JP | 2005-23424 | 1/2005 |
| JP | 2007-331005 | 12/2007 |
| JP | 2009-55248 | 3/2009 |
| JP | 2009-60207 | 3/2009 |
| JP | 2009-102732 | 5/2009 |
| JP | 2009102732 | 5/2009 |
| TW | 573018 | 11/2000 |
| TW | 200823322 | 6/2008 |
| TW | I301382 | 9/2008 |
| TW | 200925297 | 6/2009 |
| TW | 201000644 | 1/2010 |
| TW | 201016860 | 5/2010 |

OTHER PUBLICATIONS

G. Cao et al., "Mechanical properties and microstructure of SiC-reinforced Mg-(2,4)Al-1Si nanocomposites fabricated by ultrasonic cavitation based solidification processing", Materials Science and Engineering A, vol. 486, pp. 357-362, 2008.

ENCLOSURE AND ACOUSTIC DEVICE USING THE SAME

CROSS-REFERENCE TO RELATED APPLICATIONS

This application claims all benefits accruing under 35 U.S.C. §119 from China Patent Application No. 201010201342.1, filed on Jun. 14, 2010 in the China Intellectual Property Office, the contents of which are hereby incorporated by reference. This application is related to application entitled, "MAGNESIUM BASED COMPOSITE MATERIAL AND METHOD FOR MAKING THE SAME", filed Dec. 26, 2010 Ser. No. 12/978,621.

BACKGROUND

1. Technical Field

The present disclosure relates to enclosures and, particularly, to an enclosure for an acoustic device.

2. Description of Related Art

Acoustic devices such as earphones, headphones, and sound boxes, have a speaker to transform electric signals into sound, and an enclosure to enclose the speaker. The sound quality of the acoustic devices needs to improve accordingly.

The sound quality of the acoustic devices is not only related to the speaker but also to the enclosure. For example, the enclosure can produce resonance and reverberation to the sound. The commonly used plastic or resin enclosure for earphones has a long reverberation and strong resonance, which makes the sound unclear. Further, the plastic or resin enclosure has a poor durability, easily deformed, and is not relatively light enough.

What is needed, therefore, is to provide an enclosure, which has an improvement to the sound quality and an acoustic device using the same.

BRIEF DESCRIPTION OF THE DRAWING

Many aspects of the present disclosure can be better understood with reference to the following drawings. The components in the drawings are not necessarily to scale, the emphasis instead being placed upon clearly illustrating the principles of the present embodiments.

DETAILED DESCRIPTION

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean at least one.

One embodiment of an acoustic device includes an enclosure defining a hollow space and a speaker located in the hollow space. The speaker is enclosed by the enclosure. The acoustic device can be earphones, headphones, sound boxes, horns, or electrical devices having a speaker, such as mobile phones, computers, and televisions.

Figure 1:
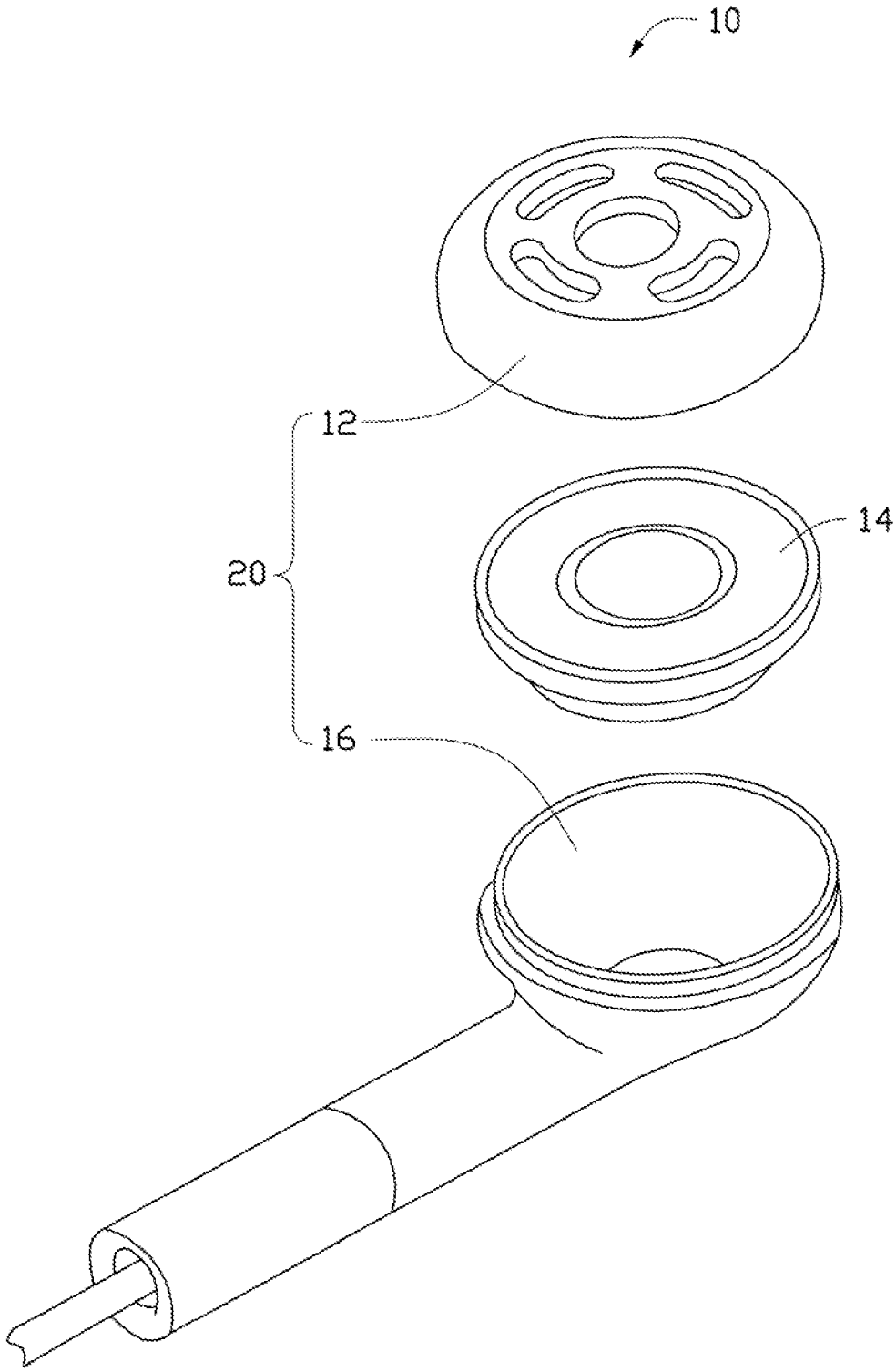
FIG. 1 is a schematic structural view of an embodiment of an acoustic device.

Referring to FIG. 1, one embodiment of the acoustic device is an earphone 10. The earphone 10 includes the enclosure 20 defining the hollow space 16 and the speaker 14 located in the hollow space 16 and enclosed by the enclosure 20. It is noted that the acoustic device is not limited to have the "earbud" structure of the earphone 10 shown in FIG. 1, but can also be other types such as ear-cup (or on-ear) type headphones, ear-hanging headphones, or in-ear type earphones.

The speaker 14 is a transducer to transform electric signals into sound. The speaker 14 can be an electro-dynamic speaker, electromagnetic speaker, electrostatic speaker or piezoelectric speaker, categorized by the working principle. In one embodiment, the speaker 14 is an electro-dynamic speaker 14.

The enclosure 20 is made of a magnesium based composite material, and thus can have a thin wall with a thickness of about 0.01 millimeters to about 2 millimeters. The enclosure 20 can include a front part 12 facing the user's ear and a back part 16 having a conduction wire therethrough. The front part 12 can further define one or a plurality of through holes 18 for sound transmission. In one embodiment, the front part 12 of the enclosure 20 of the earphone 10 is a dome shaped cover defining several through holes 18, and the back part 16 is a bowl shaped base coupled with the cover. The cover and the base cooperatively define the hollow space in the enclosure 20.

At least one of the front part 12 and the back part 16 of the enclosure 20 is made by the magnesium based composite material. In one embodiment, the entire enclosure 20 including both the cover and the base is made by the magnesium based composite material.

The enclosure 20 can have other structures and is not limited to the shape of the front part 12 and the back part 16 shown in FIG. 1. For example, the enclosure 20 of the sound box can have six rectangle shaped panels cooperatively forming a box shaped enclosure 20, wherein at least one panel is made of the magnesium based composite material.

The magnesium based composite material includes a magnesium based metal matrix and a plurality of nanoparticles dispersed therein. The nanoparticles can be selected from carbon nanotubes, silicon carbon (SiC) nanograins, alumina ($Al_2O_3$) nanograins, titanium carbon (TiC) nanograins, boron carbide nanograins, graphite nanograins, and any combination thereof. The carbon nanotubes can be selected from single-walled, double-walled, multi-walled carbon nanotubes, and any combination thereof. The diameters of the single-walled carbon nanotubes can be in a range from about 0.5 nanometers to about 50 nanometers. The diameters of the double-walled carbon nanotubes can be in a range from about 1.0 nanometer to about 50 nanometers. The diameters of the multi-walled carbon nanotubes can be in a range from about 1.5 nanometers to about 50 nanometers. The weight percentage of the nanoparticles in the magnesium based composite material can be in a range from about 0.01% to about 10%. In one embodiment, the weight percentage of the nanoparticles in the magnesium based composite material is in a range from about 0.5% to about 2%. The nanoparticles can be in the form of a powder, a fiber, or a crystal whisker. The size of the nanoparticles can be in a range from about 1 nanometer to about 100 nanometers. In one embodiment, the size of the nanoparticles is in a range from about 30 nanometers to about 50 nanometers. The material of the magnesium based metal matrix can be a pure magnesium metal or magnesium alloy. The components of the magnesium alloy include magnesium element and other metal elements selected from zinc (Zn), manganese (Mn), aluminum (Al), zirconium (Zr), thorium (Th), lithium (Li), silver, calcium (Ca), and combinations thereof. A weight ratio of the magnesium element to the other metal elements can be more than 4:1. The magnesium alloy can be AZ91, AM60, AS41, AS21, and AE42.

Figure 2:
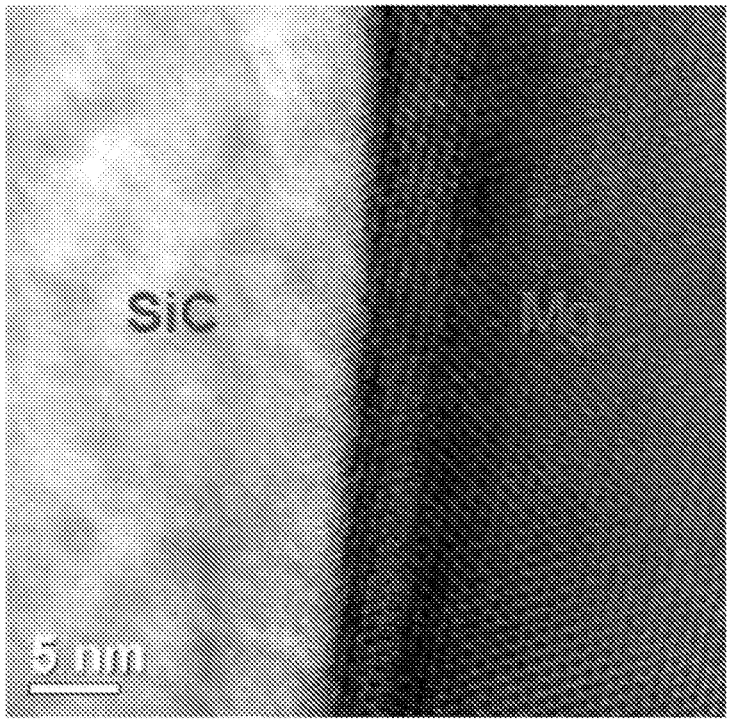
FIG. 2 is a photo showing a high resolution electron microscope (HREM) image of an interface between SiC and magnesium crystalline grain in a magnesium based composite material.
Figure 3:
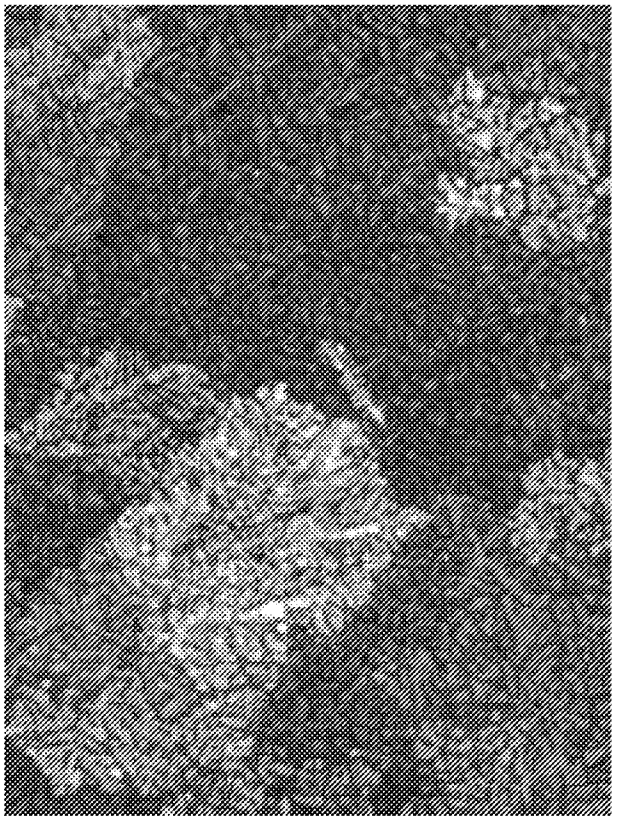
FIG. 3 is a photo showing a light microscope (LM) image of an AZ91D magnesium alloy at 50× magnification.
Figure 4:
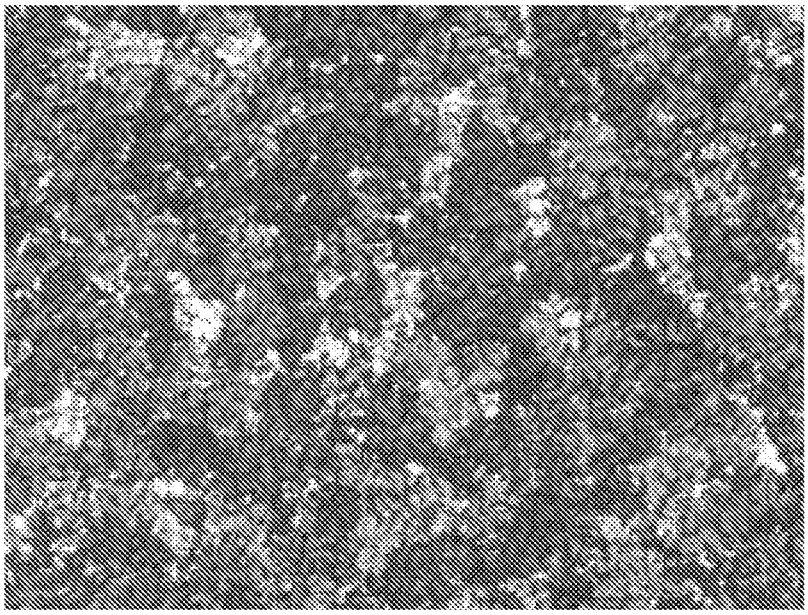
FIG. 4 is a photo showing a LM image of the magnesium based composite material having nanoparticles in an amount of 0.5% by weight, at 50× magnification.
Figure 5:
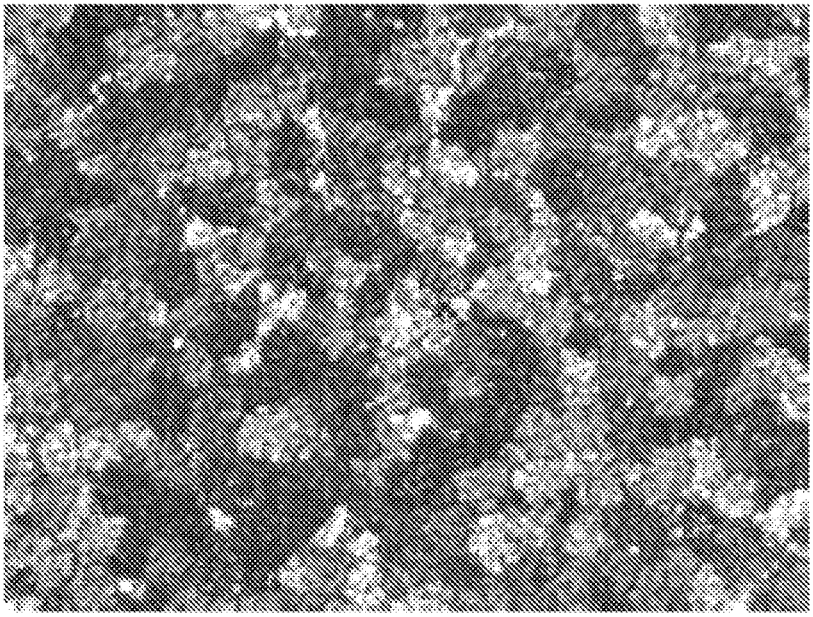
FIG. 5 is a photo showing a LM image of a magnesium based composite material having nanoparticles in an amount of 1% by weight, at 50× magnification.
Figure 6:
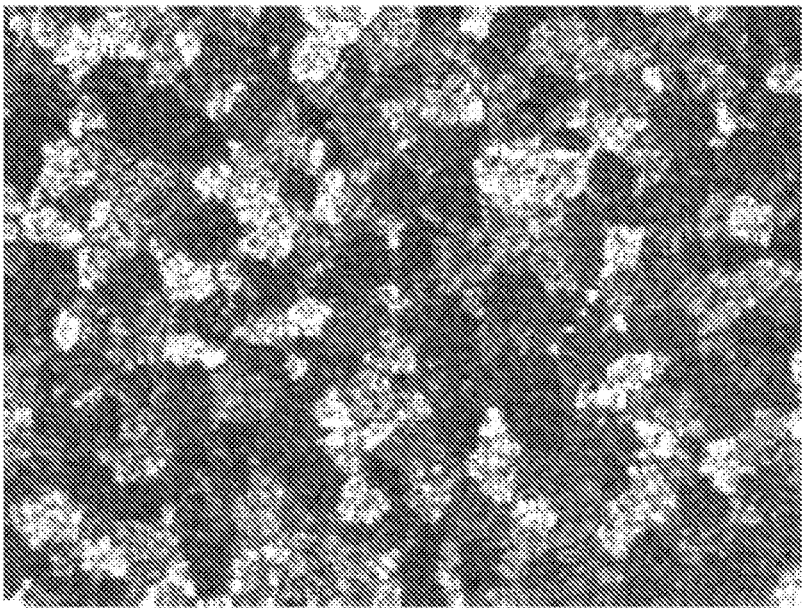
FIG. 6 is a photo showing a LM image of a magnesium based composite material having nanoparticles in an amount of 1.5% by weight, at 50× magnification.

In one embodiment, magnesium alloy composes the magnesium based composite material with the nanoparticles dispersed therein, the magnesium alloy is AZ91D, and the nanoparticles are SiC nanograins. The weight percentage of the SiC nanograins is in a range from about 0.5% to about 2%. Referring to FIG. 2, an interface between the SiC nanograin and magnesium crystalline grain is clear, without a mesophase.

In another embodiment, magnesium alloy composes the magnesium based composite material with the nanoparticles dispersed therein, the magnesium alloy is AZ91D, and the nanoparticles are carbon nanotubes. Referring to FIG. 3 to FIG. 6, the crystalline grain sizes of the pure AZ91D magnesium alloy and the magnesium based composite materials respectively having carbon nanotubes in the amount of 0.5%, 1%, and 1.5% by weight are compared by using the light microscope. The magnesium based composite materials have more fine crystalline grain sizes than the pure AZ91D magnesium alloy. By adding the nanoparticles to the magnesium based metal matrix, the crystalline grain size of the magnesium based metal matrix is about 60% to about 75% less than that of the pure AZ91D magnesium alloy. The crystalline grain size of the magnesium based composite material decreases with the increase of the weight percentage of the carbon nanotubes in the range from 0.5% to 1.5%. In one embodiment, the crystalline grain size of the AZ91D magnesium alloy of the magnesium based composite material, having the carbon nanotubes dispersed therein, is in a range from about 100 microns to about 150 microns. Therefore, the adding of the nanoparticles to the magnesium based metal matrix can refine the crystalline grain size of the magnesium based metal matrix, and thus, to increase the tensile strength and the elongation of the enclosure 20.

Figure 7:
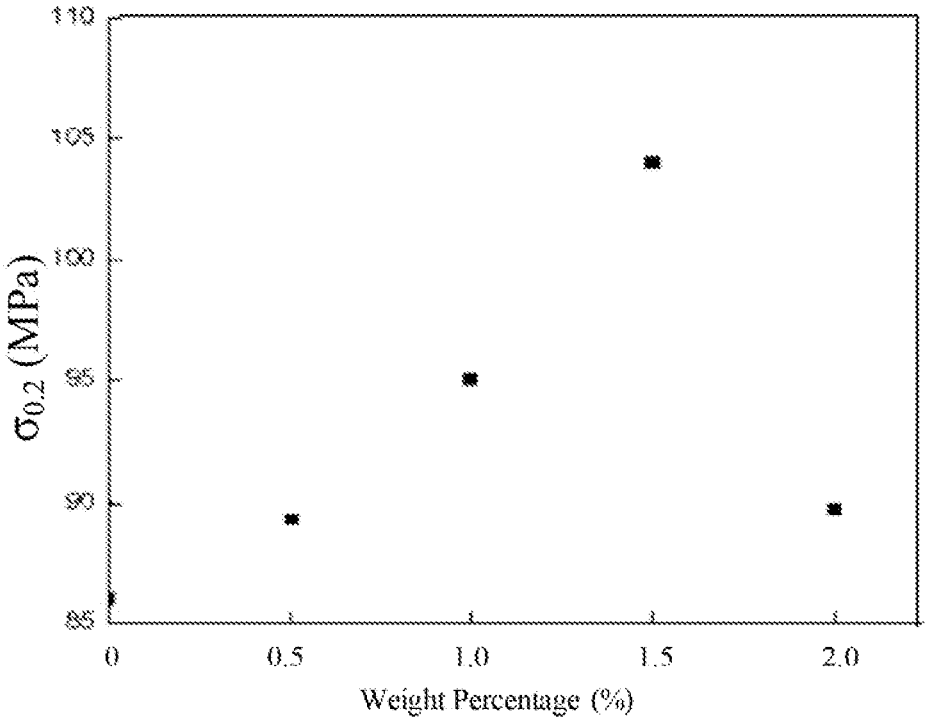
FIG. 7 is a graph showing tensile strengths of the magnesium based composite materials having different weight percentages of nanoparticles.

Referring to FIG. 7, the tensile strength of the magnesium based composite material composed by the AZ91D magnesium alloy and the carbon nanotubes dispersed therein is tested. The testing result shows that, as the increase of the weight percentage of the carbon nanotubes, the tensile strength first increases, and then decreases. The highest tensile strength is achieved at the 1.5% of the weight percentage of the carbon nanotubes.

Figure 8:
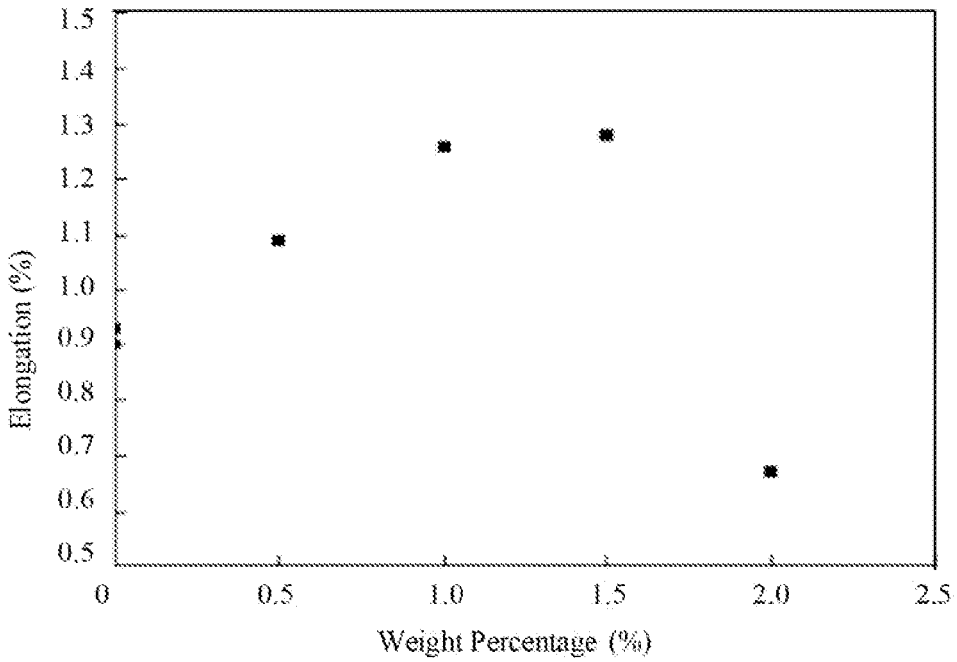
FIG. 8 is a graph showing elongations of the magnesium based composite materials having different weight percentages of nanoparticles.

Referring to FIG. 8, the elongation of the magnesium based composite material composed by the AZ91D magnesium alloy and the carbon nanotubes dispersed therein is tested. The testing result shows that as the weight percentage of the carbon nanotubes increases, the elongation first increases and then decreases. The highest elongation is achieved at the 1.5% of the weight percentage of the carbon nanotubes. The adding of the carbon nanotubes to the AZ91D magnesium alloy refines the crystalline grain size of the AZ91D magnesium alloy, and increases the tensile strength and the elongation of the magnesium based composite material. Therefore, the adding of the carbon nanotubes is suitable for increasing the strength and durability of the enclosure 20. The testing results of the magnesium based composite material composed by the AZ91D magnesium alloy and the carbon nanotubes dispersed therein are listed in the Table 1.

TABLE 1 testing results for carbon nanotubes-AZ91D composites

| Sample No. | 1 | 2 | 3 | 4 | 5 | 6 |
|---|---|---|---|---|---|---|
| Weight Percentage of Carbon Nanotubes | 0% | 0.01% | 0.5% | 1% | 1.5% | 2% |
| Tensile Strength (MPa) | 86 | 86.5 | 89 | 96 | 104 | 90 |
| Elongation (%) | 0.92 | 0.93 | 1.1 | 1.26 | 1.28 | 0.67 |

One embodiment of the method for making the magnesium based composite material includes steps:

providing magnesium based metal and a plurality of nanoparticles;

adding the plurality of nanoparticles to the magnesium based metal at a temperature of about 460° C. to about 580° C. to form a mixture, the magnesium based metal being in a molten state;

ultrasonically vibrating the mixture at a temperature of about 620° C. to about 650° C., to uniformly disperse the plurality of nanoparticles in the magnesium based metal; and casting the mixture at a temperature of about 650° C. to about 680° C., to form an ingot.

During the above steps of adding, ultrasonic vibration, and casting, the temperature of the magnesium based metal is gradually increased by three steps that is suitable for the refinement of the crystalline grain size of the magnesium based metal. The above steps are processed in a protective gas to reduce an oxidation of the molten metal. The protective gas can be an inert gas, a nitrogen gas, or combinations thereof. In one embodiment, the protective gas is nitrogen gas.

The magnesium based metal can be the pure magnesium metal or the magnesium alloys. In one embodiment, the magnesium based metal is AZ91D magnesium alloy. The nanoparticles can be carbon nanotubes or SiC nanograins. The magnesium based metal in the molten state can be previously filled in a container filled with a protective gas, and then the nanoparticles can be gradually added to the melted magnesium based metal while mechanically stirring the melted magnesium based metal, to achieve a preliminary mix between the magnesium based metal and the nanoparticles.

The vibrating step can be processed in a high energy ultrasonically vibrating device. The mixture can be ultrasonically vibrated for a period of time at a vibration frequency of about 15 kHz to about 20 kHz. In one embodiment, the vibration frequency is 15 kHz. The vibration time is from about 5 minutes to about 40 minutes. In one embodiment, the vibration time is about 30 minutes. Comparing with a commonly used vibration frequency (e.g., lager than 20 kHz, such as 48 kHz) for dispersing carbon nanotubes in a melted metal, the vibration frequency is relatively low. However, the vibration energy is relatively high. The high energy ultrasonic vibration can form a vibration having a large amplitude and cause a violent movement of the mixture. Thus, the nanoparticles can be dispersed more evenly in the melted magnesium based metal.

During the casting step, the mixture can be casted to a mold and solidified by cooling the mixture. The solid ingot can further experience an extrusion step to reallocating the nanoparticles in the ingot, thereby improving the dispersion of the nanoparticles. The enclosure 20 can be formed from the ingot by a die-casting method.

The enclosure 20 can be formed by other methods such as thixomolding, die-casting, powder metallurgy, or machining. The magnesium based metal can be melted and the nanoparticles can be added into the melted magnesium based metal, to form a liquid mixture. Then the mixture can be cooled to form a semi-solid-state paste, and die casted to form the ingot. The ingot can be machined to form a desired shape of the enclosure 20. In another embodiment, the nanoparticles and magnesium based metal powder can be mixed together and form the enclosure 20 by the powder metallurgy method.

In one embodiment, the enclosure 20 is made by the magnesium based composite material including AZ91D magnesium alloy as the matrix and the carbon nanotubes in an amount of about 1.5% by weight dispersed in the AZ91D magnesium alloy.

Referring to Table 2, the enclosures made by the magnesium based composite material with 1.5% by weight of the carbon nanotubes is compared to the enclosures made by plastic and the pure AZ91D magnesium alloy. The three enclosures have the same size and shape. The plastic including acrylonitrile butadiene styrene (ABS), and polycarbonate (PC).

TABLE 2

Comparison of different material enclosures

| Parameter | Plastic (PC + ABS) | AZ91D Mg Alloy | Carbon Nanotube-AZ91D Mg Alloy |
|---|---|---|---|
| Density (g/cm$^3$) | 1.07 | 1.82 | 1.80 |
| Yield Strength (MPa) | 39 | 230 | 276 |

The enclosure made by the magnesium based composite material has better density and yield strength.

Figure 9:
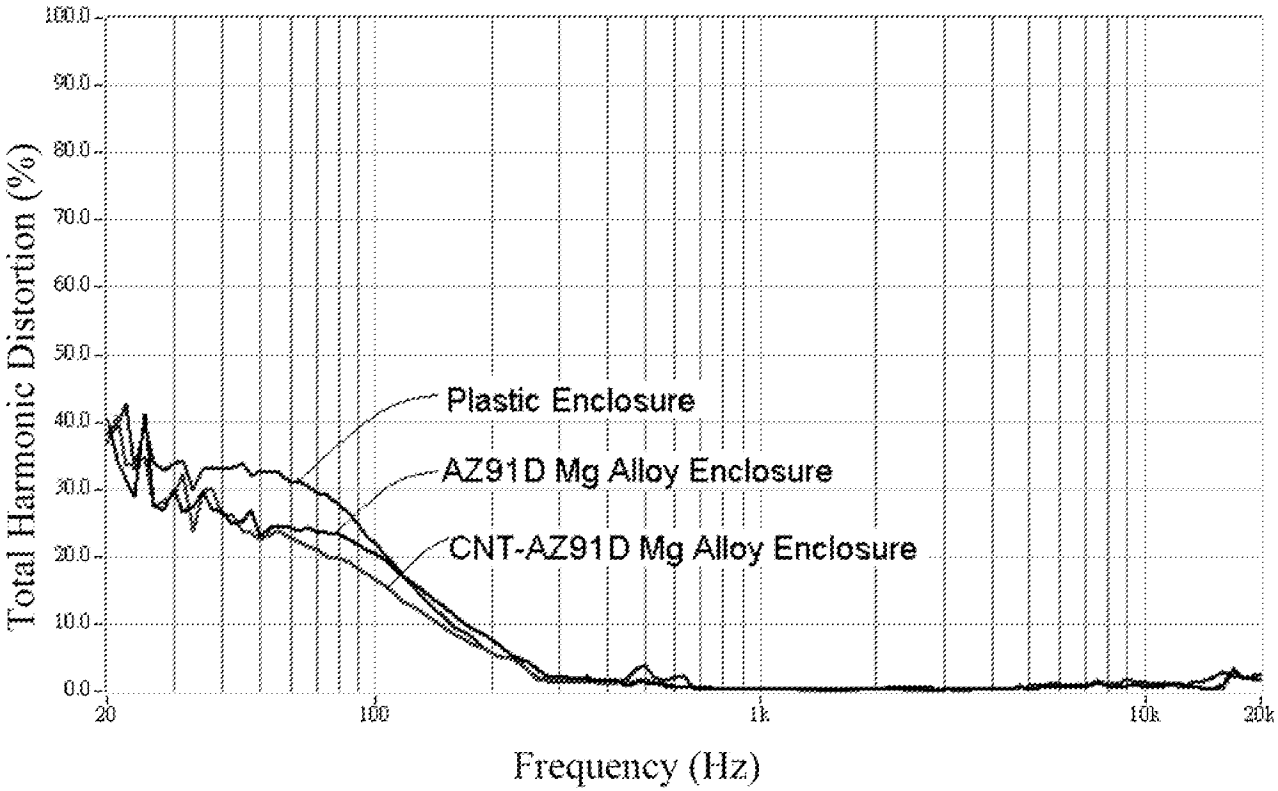
FIG. 9 is a graph showing total harmonic distortions of enclosures using different materials.

Acoustic analysis is made to earphones using the three enclosures, and reveals that the three enclosures with the same shape and size and different materials have the relatively same impedance curve and frequency response. However, referring to FIG. 9, the earphone using the enclosure made by the magnesium based composite material with 1.5% by weight of the carbon nanotubes has the lowest total harmonic distortion (THD) in the three enclosures. In a frequency range from 20 Hz to 50 Hz, the earphone using the magnesium based composite material enclosure has a THD with at least 10% less than that of the earphone using the AZ91D magnesium alloy enclosure.

Figure 10:
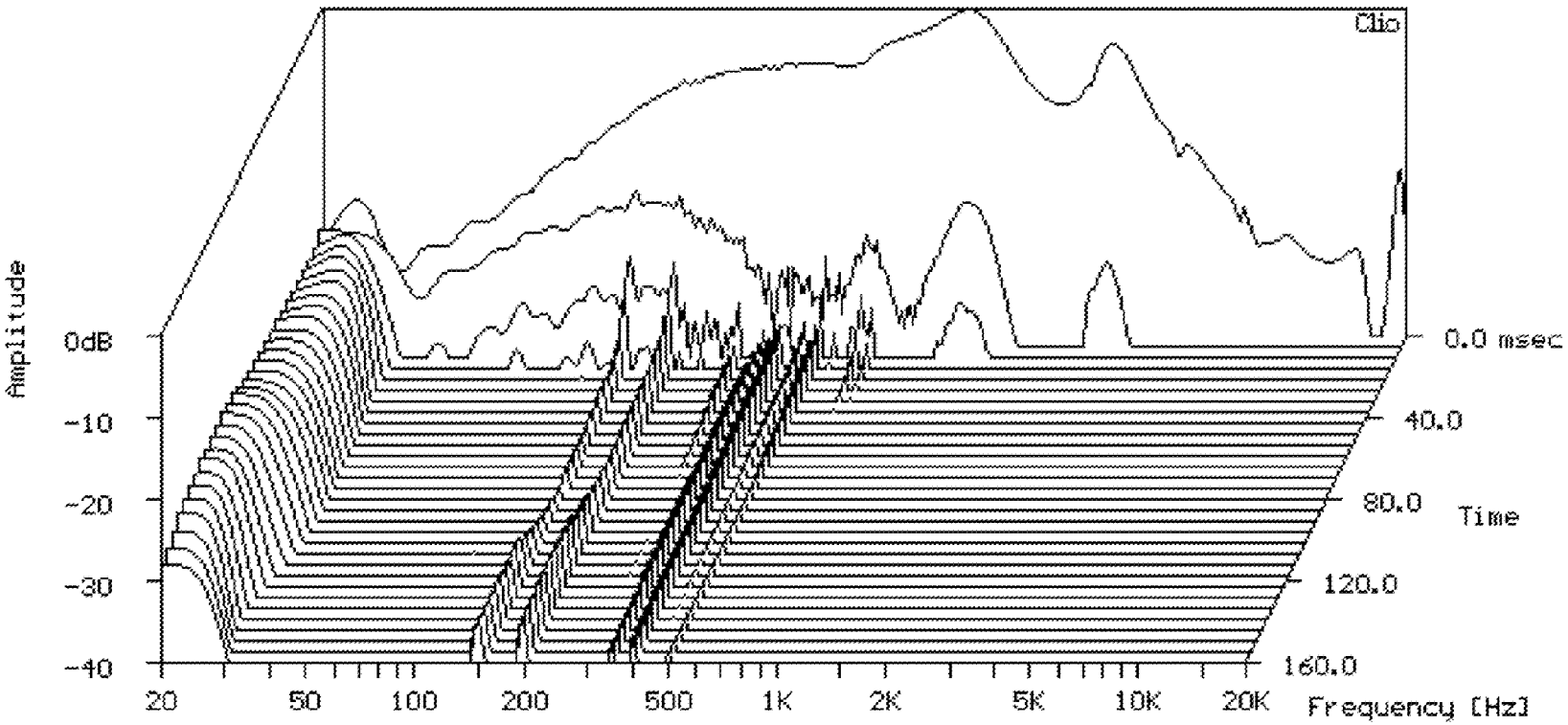
FIG. 10 is a waterfall analysis graph for the acoustic device using a plastic enclosure.
Figure 11:
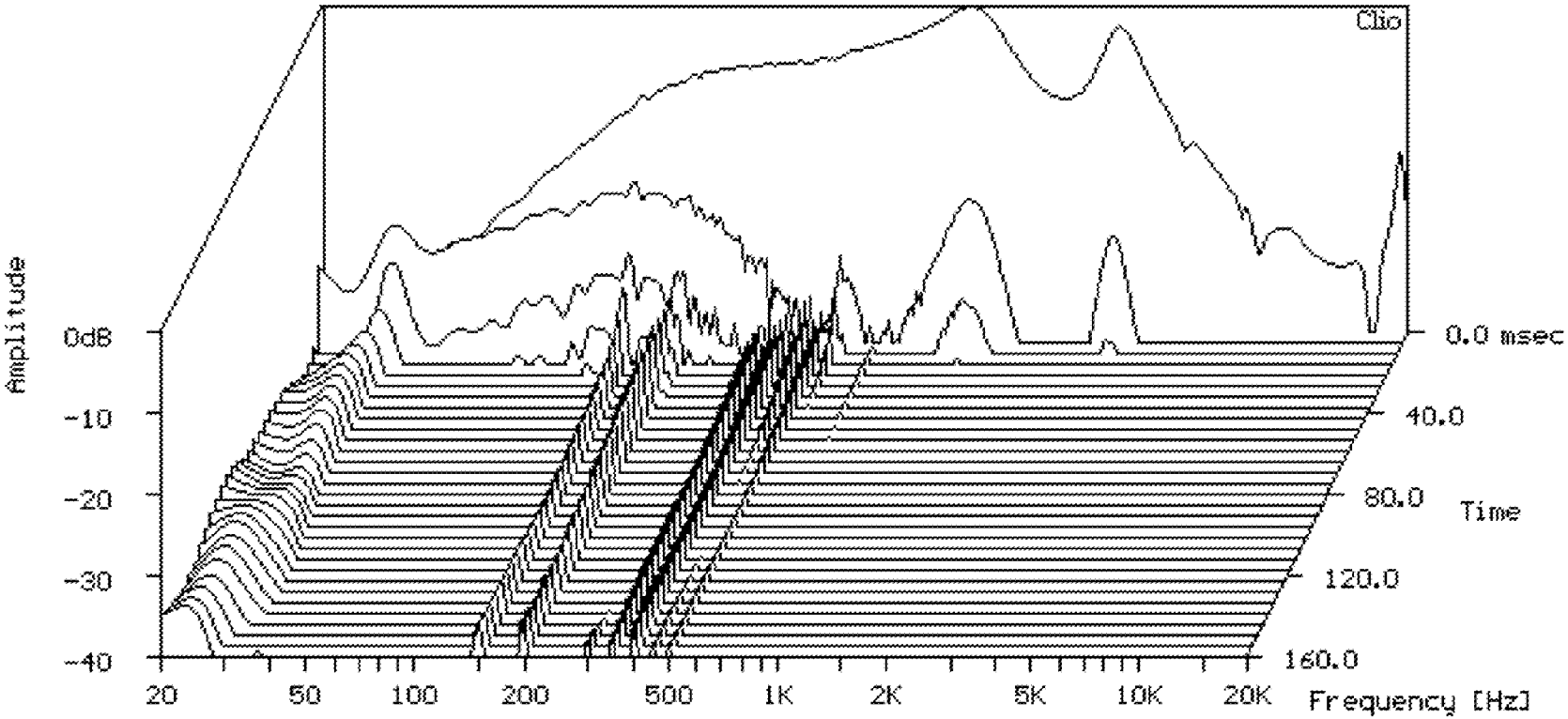
FIG. 11 is a waterfall analysis graph for the acoustic device using an AZ91D magnesium alloy enclosure.
Figure 12:
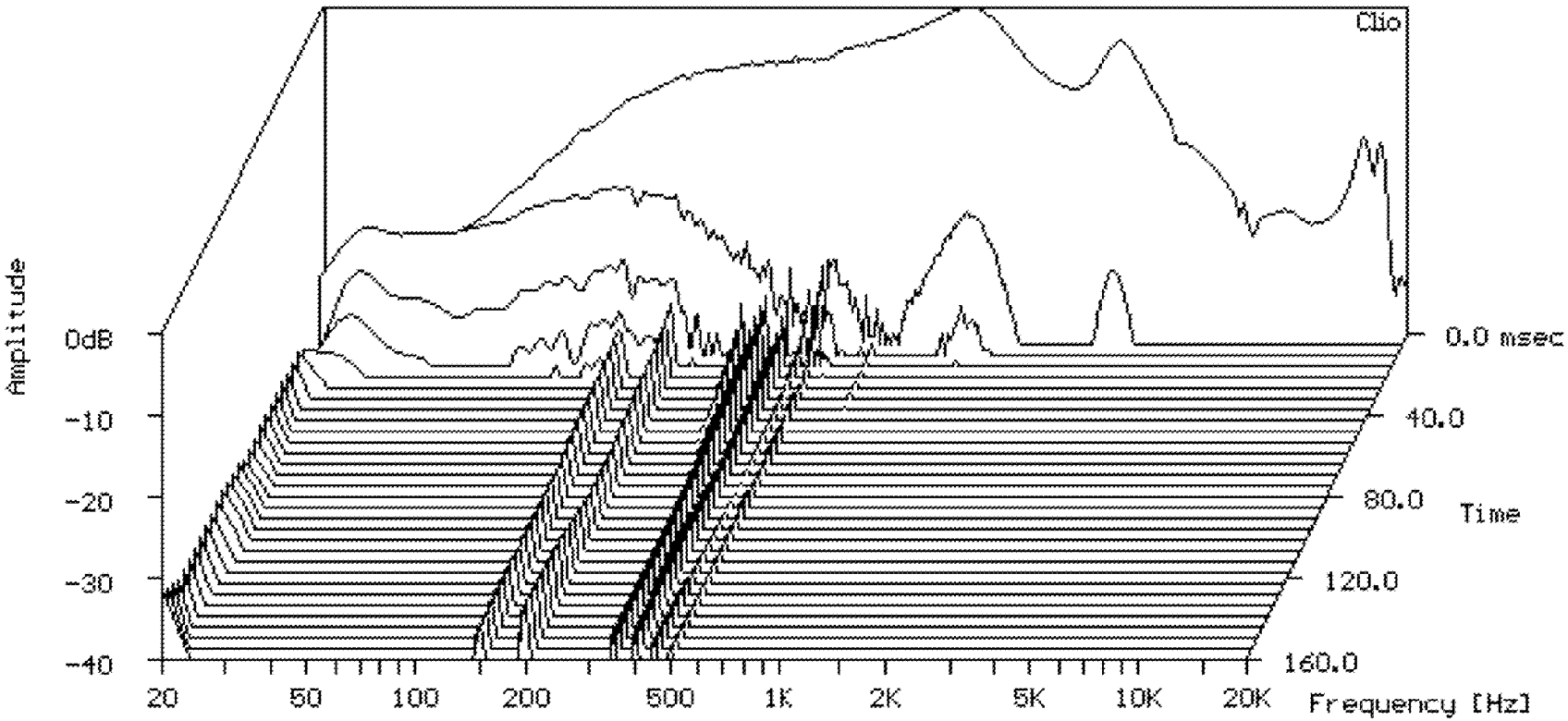
FIG. 12 is a waterfall analysis graph for the acoustic device using magnesium based composite material enclosure.

Referring to FIG. 10 to FIG. 12, the waterfall analyses are made for the earphones using the three enclosures. In a frequency range from about 20 Hz to about 30 Hz, the earphone using the enclosure made by the magnesium based composite material has the smallest amplitude and that causes its low THD. In a frequency range from about 100 Hz to about 600 Hz, the earphone using the enclosure made by the magnesium based composite material has a better wave consistence than the earphones using the other two enclosures, and thus, has the best sound clarity.

The enclosure made by the magnesium based composite material can decrease the reverberation and resonance and achieve a better sound clarity. This will improve the sound quality. Further, the enclosure made by the magnesium based composite material is more durable, and has a relatively good strength. Therefore while satisfying the needs of the strength of the enclosure, the thickness of the enclosure wall can get thinner, the total weight of the earphone will decrease, and the inner hollow space can be increased. Furthermore, the magnesium based composite material has a good thermal conductivity, which is suitable for a heat dissipation of the acoustic device.

It is to be understood that, the acoustic device besides the earphone also has the advantages of good sound quality, light weight, durability, and good heat dissipation as an earphone.

Depending on the embodiment, certain steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

Finally, it is to be understood that the above-described embodiments are intended to illustrate rather than limit the present disclosure. Variations may be made to the embodiments without departing from the spirit of the present disclosure as claimed. Elements associated with any of the above embodiments are envisioned to be associated with any other embodiments. The above-described embodiments illustrate the scope of the present disclosure but do not restrict the scope of the present disclosure.

What is claimed is:

1. An enclosure of an acoustic device, the enclosure comprises a magnesium based composite material; wherein the magnesium based composite material comprises a magnesium based metal matrix and nanoparticles dispersed therein, a weight percentage of the nanoparticles is in a range from about 0.5% to about 2% in the magnesium based composite material, a crystalline grain size of the magnesium based metal matrix is in a range from about 100 microns to about 150 microns.

2. The enclosure of claim 1, wherein the nanoparticles are selected from the group consisting of carbon nanotubes, silicon carbon nanograins, alumina nanograins, titanium carbon nanograins, boron carbide nanograins, graphite nanograins, and combinations thereof.

3. The enclosure of claim 1, wherein a weight percentage of the nanoparticles is about 1.5% in the magnesium based composite material.

4. The enclosure of claim 1, wherein a size of the nanoparticles is in a range from about 30 nanometers to about 50 nanometers.

5. The enclosure of claim 1, wherein a crystalline grain size of the magnesium based metal matrix is about 60% to about 75% less than that of a pure magnesium based metal.

6. The enclosure of claim 1, wherein a material of the magnesium based metal matrix is selected from the group consisting of AZ91, AM60, AS41, AS21, and AE42 magnesium alloys.

7. The enclosure of claim 6, wherein the material of the magnesium based metal matrix is AZ91D magnesium alloy and the nanoparticles are carbon nanotubes, and a weight percentage of the carbon nanotubes being 1.5% of the magnesium based composite material.

8. The enclosure of claim 1 comprising a wall with a thickness of about 0.01 millimeters to about 2 millimeters.

9. An acoustic device comprising an enclosure and a speaker enclosed by the enclosure, wherein the enclosure comprises a magnesium based composite material, and the magnesium based composite material comprises a magnesium based metal matrix and nanoparticles dispersed therein, a weight percentage of the nanoparticles is in a range from about 0.5% to about 2% in the magnesium based composite material, a crystalline grain size of the magnesium based metal matrix is in a range from about 100 microns to about 150 microns.

10. The acoustic device of claim 9, comprising a total harmonic distortion in a frequency range from 20 Hz to 50 Hz, and being at least 10% less than that of an identical acoustic device using AZ91D magnesium alloy.

11. The acoustic device of claim 9, wherein a crystalline grain size of the magnesium based metal matrix is about 60% to about 75% less than that of a pure magnesium based metal.

12. The acoustic device of claim 9, wherein a material of the magnesium based metal matrix is AZ91D magnesium alloy, and the nanoparticles are carbon nanotubes; and a weight percentage of the carbon nanotubes being 1.5% of the magnesium based composite material.

13. An earphone comprising an enclosure and a speaker enclosed by the enclosure, wherein the enclosure comprises a magnesium based composite material, the magnesium based metal matrix comprises a magnesium based metal matrix and nanoparticles dispersed therein, a weight percentage of the nanoparticles is in a range from about 0.5% to about 2% in the magnesium based composite material, a crystalline grain size of the magnesium based metal matrix is in a range from about 100 microns to about 150 microns.

14. The earphone of claim 13, comprising a total harmonic distortion in a frequency range from 20 Hz to 50 Hz, being at least 10% less than that of an identical earphone using AZ91D magnesium alloy enclosure.

15. The earphone of claim 13, wherein a crystalline grain size of the magnesium based metal matrix is about 60% to about 75% less than that of a pure magnesium based metal.

* * * * *